US007133000B2

(12) United States Patent
Garcia et al.

(10) Patent No.: US 7,133,000 B2
(45) Date of Patent: Nov. 7, 2006

(54) RETRACTABLE/EXTENDABLE ANTENNA ASSEMBLY

(75) Inventors: Jorge L. Garcia, Plantation, FL (US); Christos Kontogeorgakis, Coral Springs, FL (US); Sooliam Ooi, Plantation, FL (US); Arthur E. Petela, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/941,963

(22) Filed: Sep. 15, 2004

(65) Prior Publication Data

US 2006/0055624 A1 Mar. 16, 2006

(51) Int. Cl.
*H01Q 1/10* (2006.01)
*H01Q 1/24* (2006.01)

(52) U.S. Cl. ..... 343/901; 343/702

(58) Field of Classification Search ..... 343/901, 343/702; 455/575.1, 575.5, 277.1
See application file for complete search history.

(56) References Cited

U.S. PATENT DOCUMENTS 6,326,933 B1 * 12/2001 Patachi ..... 343/901
6,708,046 B1 * 3/2004 Takagi ..... 455/575.3
2003/0092415 A1 * 5/2003 Park et al. ..... 455/277.1
2004/0077389 A1 * 4/2004 Jang ..... 455/575.5
2004/0248625 A1 * 12/2004 Yoshida et al. ..... 455/575.1

* cited by examiner

*Primary Examiner*—Don Wong
*Assistant Examiner*—Angela M Lie
(74) *Attorney, Agent, or Firm*—Barbara R. Doutre

(57) ABSTRACT

An antenna assembly allows for a retractable/extendable antenna to be used in conjunction with a sealed portable communication device (200). An antenna bushing assembly (204) is used in conjunction with a sealed housing (208) having an unsealed compartment (206). The sealed housing (208) includes a radio frequency (RF) connector (210) formed therein. The bushing assembly (204) includes an RF plug (216) for mating with the RF connector (210) of the sealed housing (208). A sleeve (230) extends from the bushing assembly (204) to act as a passageway fro water intrusion into the unsealed compartment (206). An antenna (100) can thus retract and extend within the sleeve (230) of the unsealed compartment (206) while the RF connection remains intact due to the interconnect provided between the bushing assembly (204) and the sealed housing (208).

8 Claims, 3 Drawing Sheets

—PRIOR ART—

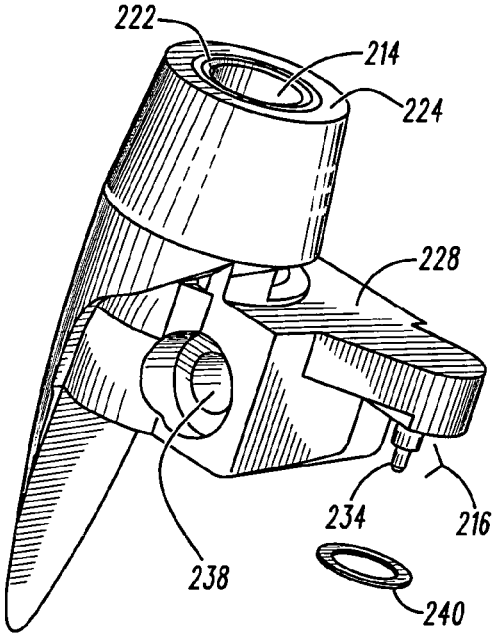
FIG. 5A
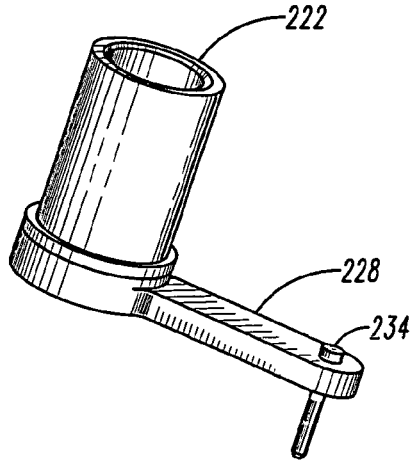
FIG. 5B
FIG. 6A
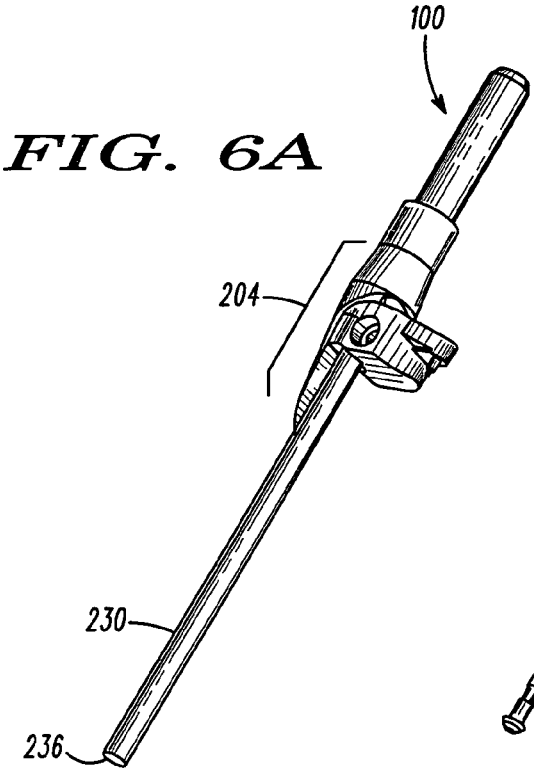
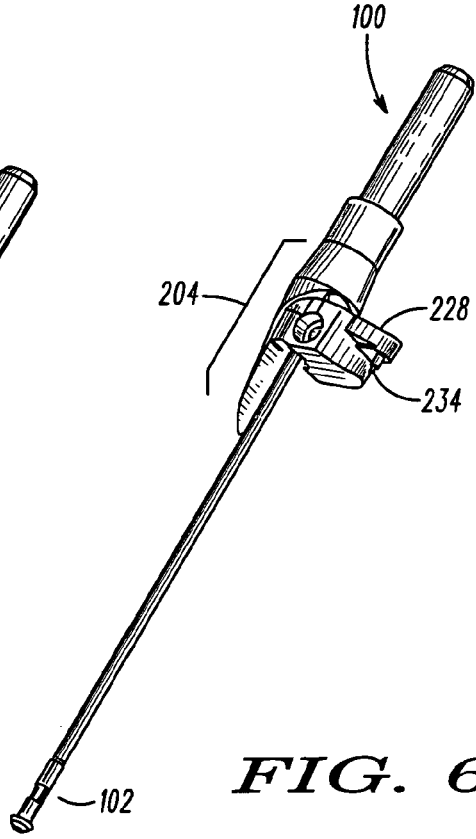
FIG. 6B

RETRACTABLE/EXTENDABLE ANTENNA ASSEMBLY

TECHNICAL FIELD

This invention relates in general to antenna assemblies and more particularly to retractable/extendable antenna assemblies for use in portable communication devices.

BACKGROUND

Portable communication devices, such as two-way radios and cell phones, are used in variety of environments. Cell phones typically address the needs of the consumer market while two-way radios are most often used in the public safety arena, such a police and fire rescue, or other commercial market. There is an ever increasing need to have these two types of communication systems overlap in terms of interoperability. While commercial radios typically have a fixed antenna system, cell phone products utilize a variety of antenna configurations. Many cell phone devices incorporate retractable/extendable antennas, such as that shown in FIG. 1, in order to minimize the overall package size of the phone while the antenna is retracted.

Prior art antenna 100 (partial cutaway view) includes first and second RF contacts 102, 104 for providing electrical contact in extended and retracted positions, respectively. A threaded portion 106 is used to connect antenna 100 to a cell phone housing (not shown). Contacts 104 make contact with threaded portion 106 in the retracted position as shown, and contacts 102 make contact with threaded portion 106 in the extended position. While a cell phone may experience degraded antenna performance in the retracted position, this performance is typically considered acceptable under certain operating conditions, such as the receive mode or data entry mode. During a transmit mode of operation or whenever coverage seems to be an issue, the user of the cell phone extends the antenna in order to maximize performance.

Retractable/extendable antennas are not typically environmentally sealed, and as such are not often used in commercial or public safety products. As cell phones begin integrating and interoperating with commercial type products, such as two-way radios, the need for an environmentally sealed communication device having a retractable/extendable antenna becomes apparent. Such an assembly would improve the reliability of the consumer type product operating within the commercial market.

Likewise, the incorporation of a retractable/extendable antenna into commercial type radio would be highly beneficial. The current day fixed antenna system can often be conspicuous or interfere with undercover operations. The retracted position would facilitate operations in which the user desires an unobtrusive device.

Accordingly, it would be highly beneficial to have an environmentally sealed communication device with a retractable/extendable antenna assembly for use in consumer and commercial type portable communication devices, such as cell phones, two-way radios and the like.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

FIG. 5A is a bushing assembly formed in accordance with the present invention;

FIG. 5B is the bushing of FIG. 5A (shown without overmold) in accordance with the present invention;

FIG. 6A is the bushing assembly with sleeve in accordance with the present invention with an antenna retracted therein; and FIG. 6B is the bushing assembly (without the sleeve) in accordance with the present invention with an antenna retracted therein.

DETAILED DESCRIPTION OF THE PREFERRED EMBODIMENT

Figure 1:
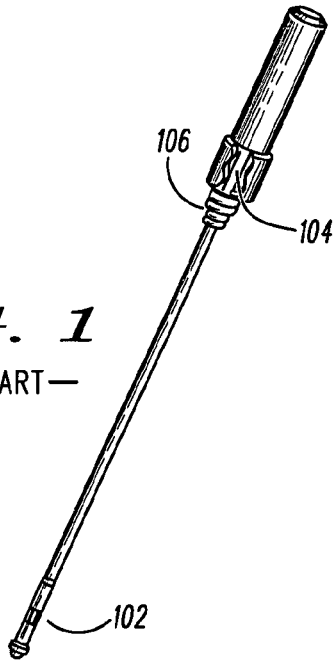
FIG. 1 is a retractable/extendable antenna known in the art.

While the specification concludes with claims defining the features of the invention that are regarded as novel, it is believed that the invention will be better understood from a consideration of the following description in conjunction with the drawing figures, in which like reference numerals are carried forward.

In accordance with the present invention, there is provided herein an antenna assembly for use in a portable communication device. An environmentally sealed communication device having a retractable/extendable antenna is provided by utilizing an antenna bushing assembly in conjunction with a sealed housing having an external unsealed compartment. The antenna retracts and extends within the unsealed compartment of the housing while the RF connection remains intact due to the interconnect provided between the bushing assembly and the sealed housing. FIGS. 2–6 provide various views of a sealed communication device along with breakouts of its sub-assemblies that provide for a retractable/extendable antenna.

Figure 2A:
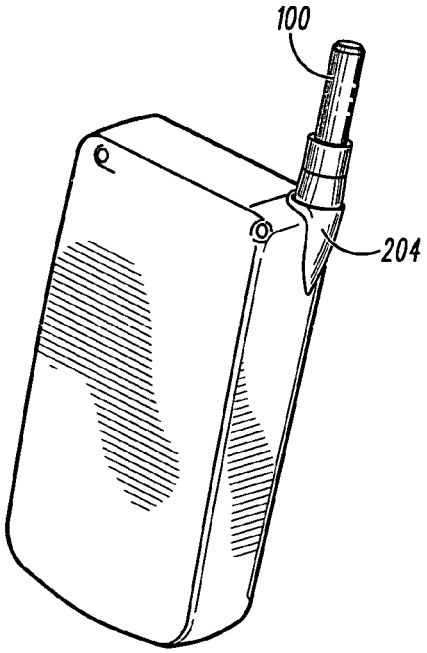
FIG. 2A and FIG. 2B show a portable communication device incorporating a retractable/extendable antenna in a retracted position and an extended position respectively in accordance with the present invention.
Figure 2B:
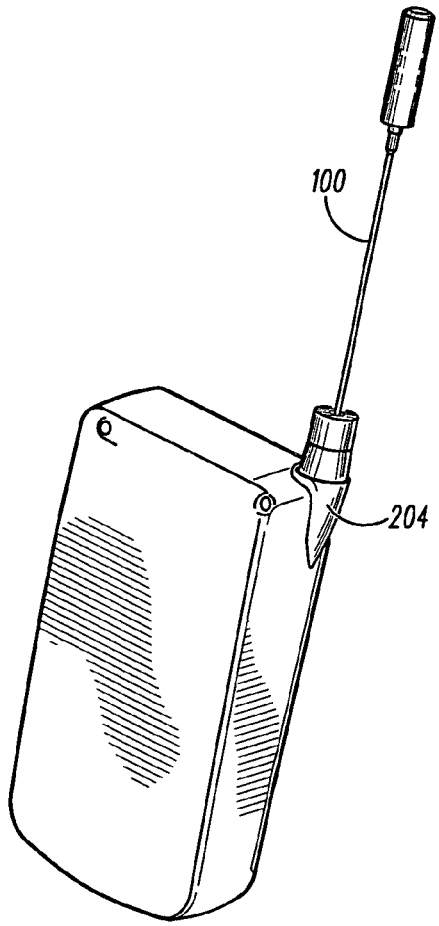

FIG. 2A and FIG. 2B show a portable communication device 200 incorporating a retractable/extendable antenna 100 into a bushing assembly 204 formed in accordance with the present invention. Communication device 200 can be a two-way radio, cell phone or other portable communication device for which a sealed environment is desired. Existing retractable/extendable antennas can be used in conjunction with the sealed portable communication device 200 in both retracted and extended positions. FIG. 2A shows antenna 100 retracted into bushing assembly 204 while FIG. 2B, shows antenna 100 extended from bushing assembly 204.

Figure 3:
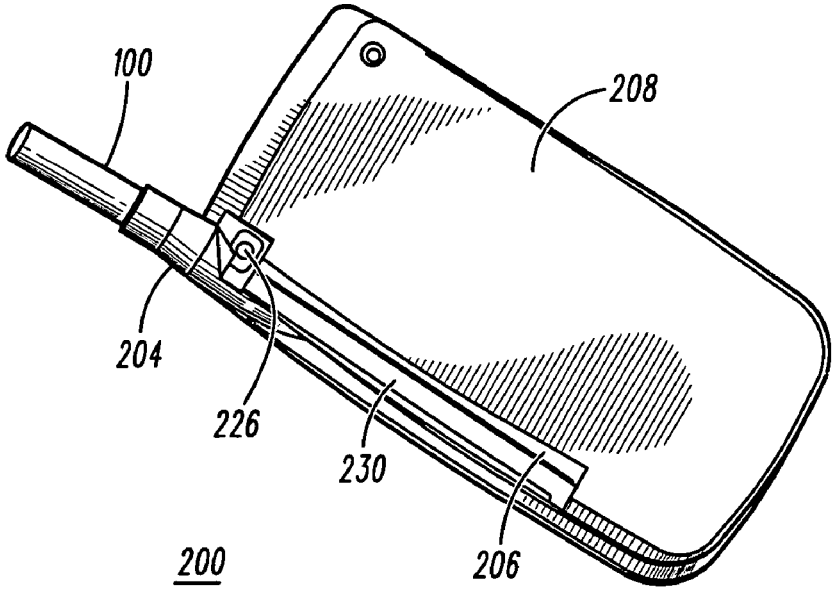
FIG. 3 is a back view of the communication device in accordance with the present invention.

FIG. 3 is a back view of the communication device in accordance with the present invention. This view shows the communication device 200 having unsealed compartment 206 and a sealed housing 208 in accordance with the present invention. The sealed housing 208 includes transmit and receive electronics (not shown) for the communication device 200. In accordance with the present invention, antenna 100 retracts into a sleeve 230 which extends from the bushing assembly 204 within the unsealed compartment 206 alongside the sealed housing 208. Sleeve 230 provides alignment for the antenna 100 within the open compartment 206 and insulation to protect the antenna's RF contacts 102 when in the retracted position. In accordance with the present invention, sleeve 230 is open at both ends so as to provide a path for water intrusion to escape into the unsealed compartment 206 and away from sealed housing 208. The bushing assembly 204 can be coupled to the sealed housing 208 via a screw 226 or other coupling means. No additional sealing geometry is needed between the antenna and the bushing/communication device housing allowing for compatibility with existing, unsealed retractable antennas.

Figure 4:
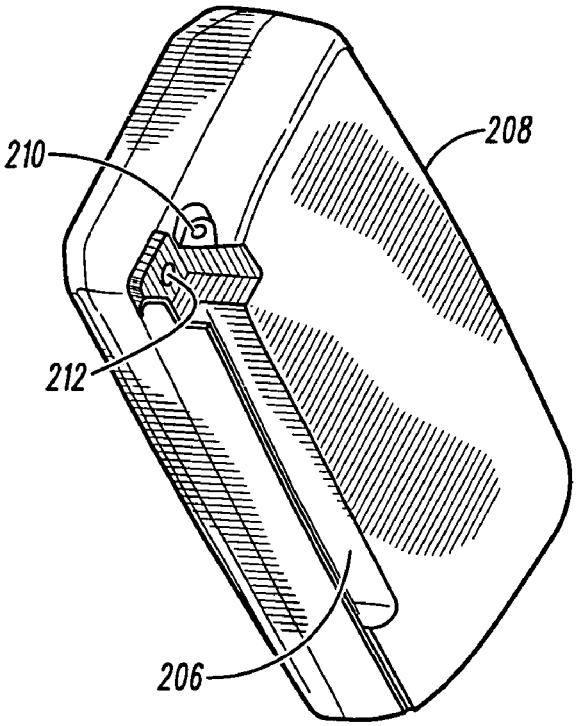
FIG. 4 is the communication device's sealed housing having an external unsealed compartment (shown without the antenna) in accordance with the present invention.

FIG. 4 shows the communication device housing (without the antenna) in accordance with the present invention. Sealed housing 208 includes a radio frequency (RF) connector 210, such as a coaxial connector, and aperture 212 formed therein and situated above the unsealed compartment 206. RF connector 210 provides an RF interface for the antenna 100 to the enclosed electronics in both the retracted and extended positions. Housing aperture 212 is used to couple the bushing assembly 204 to the sealed housing 208, such as through screw 226 shown in the previous figure.

FIG. 5A is the bushing assembly 204 formed in accordance with the present invention. Bushing assembly 204 includes a metallic bushing 222 overmolded by insulator 224. Bushing assembly 204 includes an opening 238 for aligning with housing aperture 212 and through which screw 226 gets threaded. The bushing assembly 204 of the present invention further includes a threaded through-hole 214 for receiving threaded portion 106 of antenna 100 and through which the antenna 100 can retract and extend. In accordance with the present invention, bushing assembly 204 also includes an arm 228 extending therefrom, the arm having an RF contact preferably formed of an RF pin 234 and a ground ring surrounded by insulator 224 forming an RF plug 216. In accordance with the present invention, upon mounting and aligning the bushing assembly 204 onto the sealed housing 208, the RF plug 216 will mate with the RF connector 210. A perimeter seal 240, such as an o-ring, can be placed between the RF plug 216 and RF connector of the sealed housing 208 if desired for additional sealing. FIG. 5B shows the metallic bushing 222 (without overmold 224) with the arm 228 extending therefrom and RF contact pin 234 inserted through the conductive arm.

FIG. 6A and FIG. 6B show the bushing assembly 204 of the present invention with antenna 100 coupled thereto through threaded portion 106 and metallic bushing 222. FIG. 6A is the bushing assembly 204 of the present invention with the antenna 100 retracted within the sleeve 230. This view shows sleeve 230 protecting the RF contacts 102 in the retracted position and further shows an open end 236 providing a path for water intrusion to escape. FIG. 6B is the bushing assembly (shown without the sleeve) in accordance with the present invention with antenna 100 retracted therein. In this view, antenna RF contact 104 is coupled to RF pin 234 through conductive arm 228. Likewise, in the extended position, antenna contact 102 will make contact with the RF pin 234 through arm 228.

Accordingly, the antenna assembly formed in accordance with the present invention provides for an environmentally sealed communication device regardless of whether the antenna is in the extended or retracted position making it suitable for both consumer and commercial type applications. Utilizing a sealed housing having an unsealed external compartment allows for a standard cellular style retractable/extendable antenna to be used in a communication device requiring a sealed environment. The use of a sleeve open at both ends provides a passageway for water intrusion to escape into the unsealed compartment away from the sealed housing as well as for antenna alignment and RF contact protection. No additional sealing geometry is needed between the antenna, the bushing and the communication device housing.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An antenna assembly for use in a portable communication device, comprising:

a sealed housing having an unsealed compartment, the sealed housing including a radio frequency (RF) connector formed therein;

an antenna;

an antenna bushing coupled to the sealed housing and the unsealed compartment, the antenna bushing having an aperture formed therethrough and an RF contact extending therefrom, the RF contact for mating with the RF connector of the sealed housing, the antenna retracting and extending through the aperture within the unsealed compartment of the housing;

a sleeve coupled to the antenna bushing within the unsealed compartment, the antenna retracting within and extending from the sleeve; and the sleeve being open at two ends so as to provide a path for water intrusion to escape into the unsealed compartment away from sealed housing.

2. A portable communication device, comprising:

a sealed housing having an unsealed compartment;

a radio frequency (RF) connector coupled to the sealed housing;

a bushing coupled to the sealed housing, the bushing having an RF contact for mating with the RF connector;

a sleeve coupled to the bushing and aligning within the unsealed compartment, wherein the sleeve provides a path for water intrusion to escape into the unsealed compartment away from sealed housing; and an antenna for retracting within the sleeve within the unsealed compartment and for extending from the sleeve, the antenna having first and second electrical contacts for contacting the RF contact in the retracted and extended positions.

3. The portable communication device of claim 2, wherein the sleeve further provides alignment for the antenna within the unsealed compartment and insulation of the second electrical contact when the antenna is in the retracted position.

4. An antenna assembly for a portable communication device, comprising:

a sealed housing having a radio frequency (RF) connector formed therein;

an antenna having retractable and extendable positions;

an external unsealed compartment located alongside the sealed housing, the external unsealed compartment for receiving the antenna in a retracted position;

an antenna bushing assembly coupled to the sealed housing, the antenna bushing assembly comprising:

a metallic bushing having a through-hole through which the antenna can retract and extend and having an arm extending therefrom;

an insulator overmolding the metallic bushing;

a sleeve coupled into the through-hole and located within the unsealed compartment, the sleeve providing a passageway for water into the external unsealed compartment away from the sealed housing; and an RF contact located at an end of the arm for mating with the RF connector of the sealed housing.

5. The communication device of claim 4, wherein the communication device is a cell phone.

6. The communication device of claim 4, wherein the communication device is a two-way radio.

7. The communication device of claim 4, wherein the RF connector comprises a coaxial connector.

8. An antenna bushing assembly for a retractable/extendable antenna, comprising:

a sealed housing having an unsealed compartment;

a metallic bushing coupled to the sealed housing, the metallic bushing having a through-hole through which the antenna can retract and extend, the metallic bushing having an arm extending therefrom;

a radio frequency (RF) contact coupled to the arm;

a sleeve coupled to the through-hole of the metallic bushing to provide alignment of the antenna and a passageway for water intrusion to escape into the unsealed compartment away from the sealed housing; and an insulator overmolding the metallic bushing.

* * * * *